US006458318B1

(12) United States Patent
Nishiyama et al.

(10) Patent No.: US 6,458,318 B1
(45) Date of Patent: Oct. 1, 2002

(54) HEAT RESISTANT NICKEL BASE ALLOY

(75) Inventors: Yoshitaka Nishiyama, Hyogo (JP); Toshiro Anraku, Hyogo (JP); Yoshiatsu Sawaragi, Hyogo (JP); Kazuhiro Ogawa, Hyogo (JP); Hirokazu Okada, Hyogo (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 09/606,151

(22) Filed: Jun. 29, 2000

(30) Foreign Application Priority Data

Jun. 30, 1999 (JP) ..... 11-186769
Jul. 27, 1999 (JP) ..... 11-211519

(51) Int. Cl.[7] ..... C22C 19/05
(52) U.S. Cl. ..... 420/448; 420/447; 420/449; 148/428
(58) Field of Search ..... 420/447, 448, 420/449; 148/428

(56) References Cited

U.S. PATENT DOCUMENTS

| | | | | | |
|---|---|---|---|---|---|
| 2,515,185 | A | | 7/1950 | Bieber et al. | 75/170 |
| 4,078,951 | A | * | 3/1978 | Denzine et al. | 148/428 |
| 4,128,419 | A | * | 12/1978 | Terekhov et al. | 75/171 |
| 4,227,925 | A | * | 10/1980 | Hosoi et al. | 75/171 |
| 4,388,125 | A | * | 6/1983 | Benn | 148/428 |
| 4,530,885 | A | * | 7/1985 | Restall | 420/447 |
| 4,631,169 | A | * | 12/1986 | Isobe et al. | 420/443 |
| 4,671,931 | A | | 6/1987 | Herchenroeder et al. | 420/445 |
| 4,762,681 | A | * | 8/1988 | Tassen et al. | 420/443 |
| 4,793,970 | A | * | 12/1988 | Niimi et al. | 420/447 |
| 4,871,512 | A | * | 10/1989 | Takagi et al. | 420/448 |
| 5,431,750 | A | * | 7/1995 | Kawai et al. | 148/410 |
| 5,480,283 | A | * | 1/1996 | Doi et al. | 420/448 |
| 5,556,594 | A | * | 9/1996 | Frank et al. | 420/448 |
| 5,882,586 | A | * | 3/1999 | Tamura et al. | 148/410 |
| 5,900,078 | A | * | 5/1999 | Yakuwa et al. | 148/410 |
| 6,322,643 | B1 | * | 11/2001 | Misuhashi et al. | 148/404 |

FOREIGN PATENT DOCUMENTS

| | | | | |
|---|---|---|---|---|
| JP | 54014311 | | 2/1979 | |
| JP | 55082738 | | 6/1980 | |
| JP | 57023050 | | 2/1982 | |
| JP | 04358037 | | 12/1992 | |
| JP | 05-001344 | A * | 1/1993 | C22C/19/05 |
| JP | 05033091 | | 2/1993 | |
| JP | 05033092 | | 2/1993 | |
| JP | 05033093 | | 2/1993 | |
| JP | 05093240 | | 4/1993 | |
| JP | 05093248 | | 4/1993 | |
| JP | 05195138 | | 8/1993 | |
| JP | 05239576 | | 9/1993 | |
| JP | 05239577 | | 9/1993 | |
| JP | 06207235 | | 7/1994 | |
| JP | 06207236 | | 7/1994 | |
| JP | 07054087 | | 2/1995 | |
| JP | 09241781 | | 9/1997 | |
| JP | 09243284 | | 9/1997 | |
| WO | WO 95/27803 | | 10/1995 | |

OTHER PUBLICATIONS

Rybnikov, A.I., et al., "Service Life Of Heat–Resistant Alloys With Protective Coatings In Thermocyclic Loading", Service and coatings Tehnology, Jan. 1996, vol. 78, No. 1–3, pp. 103–112.

* cited by examiner

*Primary Examiner*—Roy King
*Assistant Examiner*—Harry D. Wilkins, III
(74) *Attorney, Agent, or Firm*—Clark & Brody

(57) ABSTRACT

A heat resistant Ni base alloy comprises, on a mass% basis, 0.1% or less C, 2% or less Si, 2% or less Mn, 0.005% or less S, 10 to 25% Cr, 2.1 to less than 4.5% Al, 0.08% or less N, 0.001 to 1% in total of one or more elements of B: 0.03% or less, Zr: 0.2% or less and Hf: 0.8% or less, and 2.5 to 15% in total of one or more elements of Mo: 0.01 to 15% and W: 0.01 to 9%. The alloy is suitable as a material for a pipe used in ethylene cracking furnace.

24 Claims, No Drawings

HEAT RESISTANT NICKEL BASE ALLOY

This application claims priority under 35 U.S.C. § § 119 and/or 365 to Japan Patent Application No.11-186769 and 11-211519 filed in Japan on Jun. 30, 1999 and Jul. 27, 1999, respectively, the entire content of which is herein incorporated by reference.

BACKGROUND OF THE INVENTION

1. Field of the Invention

The present invention relates to a heat resistant Ni base alloy having high strength at high temperature and excellent in hot workability, weldability, and carburization resistance. The alloy of the present invention is suitable in particular as a material of tubes used in naphtha reforming furnaces and ethylene cracking furnaces for producing petrochemical fundamental products such as ethylene and propylene by cracking with steam hydrocarbon materials such as naphtha, propane, ethane, and gas oil at a high temperature of 800° C. or more.

2. Description of the Related Art

The service temperature of the tubes used in ethylene cracking furnaces tends to be higher from the viewpoint of improving an ethylene yield ratio. Materials of such cracking furnace tubes require high-temperature strength, carburization resistance and heat resistance because their inside is exposed to a carburization atmosphere.

On the other hand, carbon is deposited on the inside surface of a cracking furnace tube during the operation (this phenomenon is called coking), and as the amount of carbon deposited on the inside of the tube increases, disadvantages in operation occur, such as an increase in the internal pressure of the tube and a reduction in the heating efficiency. Therefor, coking resistance is required. In the actual operation, the so-called decoking operation for removing deposited carbon by air or steam is periodically conducted, but the suspension of the operation and the working load are great problems.

Such coking and its related problems are more serious when the cracking furnace tube has a smaller diameter which is advantageous for improving the yield.

JP Publication No. A 2-3336 discloses the technique of inhibiting coking in which more than 28% Cr is contained in an alloy to form a strong and stable $Cr_2O_3$ layer on the surface of the alloy in order to prevent the coking-promoting catalytic elements of Fe and Ni from being exposed to the surface of the alloy.

On the other hand, increasing of the Si content in an alloy is known to be effective for improving carburization resistance, as disclosed in e.g. JP Publication No. A 57-23050.

In the prior art described above, however, there are problems as follows:

When the high-Cr alloy disclosed in JP Publication No. A 2-8336 is applied as a structural member with high-temperature strength for the prevention of coking, the metal structure should be austenitized by increasing the Ni content in the alloy, but, as the result, its high-temperature strength becomes lower than that of the conventional alloy. Therefore, the application thereof as a structural member with high-temperature strength is difficult.

JP Publication No. A 2-336 discloses that an alloy poor in high-temperature strength is combined for use with another member with high-temperature strength to form a cladded tube, but the cladded tube is problematic in respect to the production cost and reliability.

The present inventors found previously that the carburization resistance and coking resistance can be significantly improved by forming a strong and tight $Al_2O_3$ layer on the surface of a metal by increasing the content of Al in an alloy, compared with the conventional alloy, and the g' phase is finely precipitated in the matrix during the service at high temperature by increasing the content of Ni in such a high-Al alloy, and the creep rupture strength can also be significantly improved. The patent for this alloy was applied as a Ni base alloy suitable as a tube in an ethylene cracking furnace in Japanese Patent Application No. 3-308709 (Publication No. A4-358037) and Japanese Patent Application No. 4-41402 (Publication No. A5-2395 77) respectively. However, in consideration of mass production on a commercial scale, an large amount of hot working was required for the production of the Ni base alloy with high-Al but the hot workability of such alloy was not satisfactory.

With respect to the Ni base alloy with an increased content of Al, alloys excellent in oxidation resistance are disclosed in JP Publication No. B 3-46535 and A 60-238434. However, the alloys disclosed in these publications are also poor in hot workability and weldability, because adequate attention was not paid to these characteristics on the design of alloying components. Further alloys excellent in carburization resistance and high-temperature strength are also disclosed in JP Publication No. A 7-54087 and A 9-243284, but attention was not actually paid to hot workability and weldability.

SUMMARY OF THE INVENTION

The object of the present invention is to provide a heat resistant alloy which is excellent in carburization resistance and coking resistance under the environment where ethylene cracking furnace tubes are used, more specifically, carburization, oxidation and temperature change are repeated; and also which is excellent in hot workability and weldability and has excellent high-temperature strength.

The summary of the present invention is as follows:

(1) A heat resistant Ni base alloy excellent in hot workability, weldability, and carburization resistance comprising, on a mass% basis, C: 0.1% or less, Si: 2% or less, Mn: 2% or less, S: 0.005% or less, Cr: 10 to 25%, Al: 2.1 to less than 4.5%, N: 0.08% or less, 0.001 to 1% in total of one or more elements of B: 0.03% or less, Zr: 0.2% or less and Hf: 0.8% or less, 2.5 to 15% in total of either one or both of Mo:0.01 to 15% and W: 0.01 to 9%, Ti: 0 to 3%, Mg: 0 to 0.01%, Ca: 0 to 0.01%, Fe: 0 to 10%, Nb: 0 to 1%, V: 0 to 1%, Ta: 0 to 2%, Y: 0 to 0.1%, La: 0 to 0.1%, Ce: 0 to 0.1%, Nd: 0 to 0.1%, Cu: 0 to 5%, Co: 0 to 10%, and the balance being substantially Ni.

(2) The heat resistant Ni base alloy according to above (1), wherein the Ti content is 0.005 to 3% by mass.

(3) The heat resistant Ni base alloy according to above (1), wherein the Ti content is 0.005 to 3% and either one or both of Mg and Ca are contained in an amount of 0.0005 to 0.01% and 0.0005 to 0.01%, respectively.

(4) The heat resistant Ni base alloy according to above (1), wherein the Ti content is 0.005 to 3%, either one or both of Mg and Ca are contained in an amount of 0.0005 to 0.01% and 0.0005 to 0.01%, respectively, and Fe content is 0.1 to 10%.

(5) A heat resistant Ni base alloy comprising, on a mass % basis, C: 0.07% or less, Si: 0.01 to 1%, Mn: 1% or less, S: 0.0025% or less, Cr: 12 to 19%, Al: 2.1 to less than 3.8%, N: 0.045% or less, 0.001 to 1% in total of one or more elements of B: 0.03% or less, Zr: 0.2% or less and Hf: 0.8% or less, Mo: 2.5 to 12%, Ti: 0.005 to 1%, Ca: 0.0005 to 0.01%, Fe: 0.1 to 10%, and the balance being essentially Ni.

In order to obtain the alloy which satisfies the essential characteristics required as a commercial production alloy such as hot workability and weldability without lowering carburization resistance and coking resistance at high temperatures, the present inventors carried out extensive experiments on alloy, with various chemical compositions and reached the following findings as a result.

a) Even if the Ni base alloy does not contain Al in an amount of 4.5% or more unlike the conventional alloy, an alumina-based oxide layer can be formed on the surface of the alloy contenting less than 4.5% Al by means of containing not less than 10% Cr and reducing the N content, whereby excellent carburization resistance and coking resistance can be attained and also high-temperature strength is improved.

b) The N in an alloy containing not less than 1% Al easily forms Al nitride, and the alumina-based oxide layer tends to lose its protective property from this nitride precipitation which acts as the initiation point.

c) By reducing the Al content to less than 4.5%, hot workability and weldability of the Ni base alloy containing Al are improved, but compared with conventional Fe—Cr—Ni alloys or Ni—Cr alloys, are still unsatisfactory in consideration of mass production. This is because Ni—Al intermetallic compounds precipitate at the time of hot working or welding, and the inside of the grains of the alloy are significantly reinforced so that the grain boundaries are relatively weakened, which result in both a reduction of hot workability and an occurrence of a hot cracking at the time of welding. Accordingly, the reinforcement of the grain boundaries which can compete with the reinforcement of the inside of the grains is important and effective for improving hot workability and weldability.

d) On the other hand, in the Ni base alloy containing a large amount of Al, the grain boundaries are weakened and S is one of the main factors in weakening the grain boundaries. Therefore, it is important for improving hot workability to limit the S content to 0.005% or less, and further improving effects can be expected by limiting S content to 0.003% or less.

e) Further, the elements, of B, Zr and Hf enhance the binding force of grains on the grain boundaries and are effective for reinforcing the grain boundaries. Therefore, it is preferable that one or more of these elements are contained while the S content is reduced.

f) The reduction of S content as described above and the incorporation of one or more elements of B, Zr and Hf are effective for preventing the reduction of hot workability and the occurrence of hot cracking at the time of welding but these measures only are still not satisfactory. Further, it is also important to reduce the N content to the lowest degree. This is because the N in the Ni base alloy containing a large amount of Al easily forms Al nitride as described above, and these nitrides precipitation significantly inhibit hot workability and weldability.

DETAILED DESCRIPTION

The following describe the chemical composition of the alloy of the present invention and its effects. The term "%" for alloying elements means % by mass.

C:

C is a very effective element which forms carbides to improve tensile strength and creep rupture strength required for heat-resistant steel. However, if the C content exceeds 0.1%, the ductility and toughness of the alloy are significantly lowered, and further the formation of an alumina layer on the Al-containing Ni base alloy is inhibited, and thus the upper limit is defined as 0.1%. The content is preferably 0.09% or less. The C content is more preferably 0.07% or less.

Si:

Si is an element which is important as a deoxidation element and further contributes to improvements in oxidation resistance and carburization resistance, but it effect on the Al-containing Ni base alloy is relatively low. For the Ni base alloy containing a large amount of Al, however, Si has a strong action of lowering hot workability and weldability, and thus the Si content is preferably lower when particularly, hot workability in manufacturing is regarded as important. However, in consideration of the contribution of Si to oxidation resistance and carburization resistance, the Si content must be 2% or less. Desirably, the content of Si should be 0.01 to 1.5%, more desirably 0.01 to 1%.

Mn:

Mn is an effective element as a deoxidization element but is an element promoting the formation of a spinel type oxide layer which is a major factor for deterioration of coking resistance, and thus its content should be reduced to 2% or less. Desirably, the content of Mn should be 1% or less.

S:

S is a very harmful element which is segregated on grain boundaries to weak the binding force of grains and to deteriorate hot workability, and thus, the regulation of its content upper limit is very important. Since the reinforcement of the grain boundaries is particularly important in the Al-containing Ni base alloy, S is preferably reduced to the lowest degree. To improve hot workability and weldability, the S content should be 0.005% or less. Desirably, the content of S should be 0.003% or less. More desirably, the content of S should be 0.0025% or less.

Cr:

Cr is an effective element for improving oxidation resistance and coking resistance, and has an action of forming an alumina layer uniformly at an initial stage of its formation. Further, this element also forms carbides which contribute to the improvement of creep rupture strength. In addition, Cr contributes to the improvement of hot workability in the alloying system defined in the present invention. To achieve these effects, this element should be contained in an amount of 10% or more. On the other hand, when Cr is contained in excess, the formation of a uniform alumina layer is conversely inhibited, while mechanical properties such as toughness and workability are further inhibited. Accordingly, the Cr content is defined as 10 to 25%. Preferably, the content of Cr should be 12 to 23%. More preferably, the content of Cr should be 12 to less than 20%.

Al is a very effective element for improving carburization resistance and choking resistance and further improving high-temperature strength. To achieve these effects, a corundum type alumina scale must be uniformly formed. On the other hand, a precipitation reinforcing action by form the γ' phase ($Ni_3(Al,Ti)$ intermetallic compound) can be expected. To achieve these effects, an Al content of at least 2.1 % is necessary. On the other hand, if the Al content is 4.5% or more, hot workability is significantly lowered. Accordingly, the Al content must be 2.1% or more to less than 4.5%. Preferably, the content of Al should be 2.1% to less than 4%, and more preferably 2.1% to less than 3.8%.

N:

The N content is one of the essential prescriptions in the present invention. In the conventional heat-resistant steel, N is effective and positively used for increasing the high temperature strength due to the solid-solution strengthening. However, in the Al-containing nickel base alloy, N cannot be expected to attain the solid-solution strengthening because of precipitation thereof as a nitride such as AlN in the alloy, and this element further significantly reduces hot workability and weldability. In addition, there is a problem that the protective layer is destroyed by the nitride as the starting point, resulting in the deterioration of carburization resistance. However, since a excessive reduction in the N content causes an increase in costs for refining, the N content must be 0.08% or less. However, this element should essentially be reduced to the lowest degree, desirably 0.055% or less. More preferably, the content of N should be 0.045% or less.

B, Zr, Hf:

These elements are effective mainly for reinforcing grain boundaries in the alloy and contribute to improvements in hot workability and weldability, and thus one or more of these elements should be contained. However, if these elements are contained in excess, a reduction in creep rupture strength is caused, and thus the upper limits of these elements must be 0.03% for B, 0.20% fo Zr, and 0.8% for Hf respectively, and their content in total must be 1%. Further, their content in total must be at least 0.001% in order to achieve the effects described above.

Mo, W:

Mo and W are effective mainly as solid solution strengthening elements, and by reinforcing the austenitic phase of the alloy, creep rupture strength is increased. If these elements are contained in excess, not only intermetallic compounds leading to a reduction in toughness are precipitated but carburization resistance and coking resistance are also deteriorated. If these element are contained, the upper limit in terms of the total of one or more elements of Mo and W should be 15% or less. Particularly, for application to members whose creep rupture strength is regarded as important, it is effective to positively add Mo and W to demonstrate this effect. As compared with Mo, W causes a more significant reduction in hot workability and weldability due to the precipitation of intermetallic compounds, and thus the upper limit of W should be lower than that of Mo. Accordingly, the total content of Mo and/or W must be 2.5 to 15% wherein the Mo content is 0.01 to 15% and the W content is 0.01 to 9%.

Ni:

Ni is an indispensable element for achieving a stable austenitic structure and for ensuring carburization resistance, and should be contained desirably in a higher amount to increase the effect of precipitation reinforcement particularly by the γ' phase.

To solve the problem of the present invention, the alloy should have at least the chemical composition described above, but the following elements may be contained as necessary.

Ti:

Ti is an element for promoting the precipitation of γ' phase to improve creep rupture strength. Further, this element also contributes to the reinforcement of grain boundaries. To achieve these effects, Ti is contained preferably in an amount of 0.005% or more. However, if it is contained in excess, the γ' phase is precipitated in excess, and thus, hot workability and weldability are significantly deteriorated. Accordingly, if Ti is contained, the content of Ti should be 3% or less. Preferably, the content of Ti should be 1% or less.

Mg and Ca:

These elements have a action of fixing a harmful S for hot workability as sulfides, thus increasing the strength of grain boundaries and improving hot workability, and therefore, these elements may be contained as necessary. To achieve these effects, each of these elements should be contained preferably in an amount of 0.0005% or more. However, if they are contained in excess, hot workability and weldability are conversely deteriorated. Accordingly, the upper limit for each of Mg and Ca should be preferably 0.01%. If these elements are to be contained, preferably, they should be contained, such that [(1.178 Mg+Ca)/S] is in the range of 0.5 to 3.

Fe:

Fe improves creep elongation, increases creep rupture strength, and contributes to improvements in hot workability and workability at normal temperature. To achieve these effects, this element should be contained preferably in an amount of 0.1% or more. However, if it is contained in excess, both creep rupture strength and hot workability are lowered conversely, and thus, when it is to be contained, preferably, its content upper limit should be 10%.

Nb, V and Ta:

These elements contribute to the improvement of creep rupture strength as carbides and nitride or as solid solutions in the austenitic phase or the γ' phase. To achieve these effects, each of these elements should be contained preferably in an amount of 0.01% or more. However, if these elements are contained in excess, a reduction in toughness is caused, and thus, when these are to be contained, the upper content limits of these elements should be preferably 1% for Nb or V, respectively and 2% for Ta. When two or more of these elements are used in combination, their content in total should be desirably 3% or less.

La, Ce and Nd:

These elements may be contained as necessary because they have not only the effect of preventing the exfoliation of an alumina layer under the conditions where the alloy is repeatedly heated and cooled, but also the effect of improving carburization resistance and coking resistance for use under the environment where the temperature is fluctuated. To achieve these effects, each of these elements should be contained preferably in an amount of 0.002% or more. However, when these are contained in excess, the effect of preventing the exfoliation of an alumina layer is saturated and further the workability is worsened. Accordingly, the upper limits of La, Ce and Nd content should be preferably 0.1%, respectively. These elements may be contained alone or in combination thereof.

Cu, Co:

Cu and Co may be substituted as necessary for a part of Ni to stabilize mainly the austenitic phase. However, if these elements are added in excess, toughness an workability are deteriorated. Accordingly, the upper limit of Cu content must be 5% or less. The Cu content should be preferably 3% or less, more preferably 1.5% or less. In addition, the upper limit of Co content must be 10%. The content of Co is preferably 8% or less, more preferably 5% or less. Further, Co has an action of improving creep strength by the solid solution strengthening. The lower limit of each of these elements should be preferably 0.01% or more.

Among alloys in the range of those chemical compositions described above, an alloy particularly excellent in various characteristics has preferably the following chemical composition:

C: 0.07% or less, Si: 0.01 to 1% or less, Mn: 1% or less, S: 0.0025% or less, Cr: 12 to less than 20%, Al: 2.1 to less than 3.8%, and N: 0.045% or less, 0.001 to 1% in total of one or more metals of B: 0 to 0.03%, Zr: 0 to 0.2% and Hf: 0 to 0.8%, and Mo: 2.5 to 12%, Ti: 0.005 to 1%, Ca: 0.0005 to 0.01%, and Fe: 0.1 to 10%.

The alloy of the present invention can be obtained by conventional melting and refining process and then casting, and the alloy as casting can also be used. Usually, this alloy after casting is formed into products such as tubes by way of various processing steps such as forging, hot working and cold working. The alloy may be formed into products by powder metallurgical method. Heat treatment promotes the uniformity of the metal structure and contributes to improvements in the performance of the alloy of the present invention. In this case, the uniformization heat treatment is preferably carried out at 1100 to 1300° C., but the alloy as casting or processing can also be used.

Embodiment

Alloys with the chemical compositions shown in Table 1 were melt in a 50 kg vacuum high-frequency furnace, then formed by forging into plate materials with a thickness of 15 mm, and subjected to solution heat treatment at 1250° C. and then test specimens were prepared.

TABLE 1

| | (Weight %, balance: Ni) | | | | | | | | |
|---|---|---|---|---|---|---|---|---|---|
| Symbol | C | Si | Mn | S | Cr | Al | N | B | Zr |
| 1 | 0.025 | 0.15 | 0.88 | 0.0023 | 15.2 | 2.8 | 0.042 | 0.002 | — |
| 2 | 0.006 | 0.05 | 0.12 | 0.0001 | 15.9 | 3.1 | 0.001 | 0.004 | — |
| 3 | 0.010 | 1.85 | 0.25 | 0.0015 | 15.3 | 2.1 | 0.015 | — | — |
| 4 | 0.012 | 0.19 | 0.68 | 0.0042 | 24.0 | 3.1 | 0.005 | — | 0.187 |
| 5 | 0.068 | 0.89 | 0.24 | 0.0002 | 14.9 | 2.8 | 0.002 | 0.003 | 0.020 |
| 6 | 0.025 | 0.54 | 0.66 | 0.0010 | 18.5 | 3.5 | 0.008 | 0.002 | — |
| 7 | 0.066 | 0.24 | 0.90 | 0.0009 | 20.2 | 3.3 | 0.007 | — | 0.015 |
| 8 | 0.078 | 0.21 | 0.05 | 0.0005 | 16.4 | 3.4 | 0.011 | 0.004 | — |
| 9 | 0.015 | 0.21 | 0.58 | 0.0003 | 19.8 | 2.5 | 0.010 | 0.025 | — |
| 10 | 0.006 | 0.35 | 0.18 | 0.0002 | 15.3 | 4.2 | 0.018 | 0.008 | — |
| 11 | 0.033 | 0.34 | 0.20 | 0.0010 | 14.5 | 3.0 | 0.024 | 0.003 | — |
| 12 | 0.011 | 0.09 | 0.15 | 0.0002 | 14.9 | 3.2 | 0.011 | 0.004 | — |
| 13 | 0.027 | 0.37 | 0.15 | 0.0008 | 13.8 | 2.6 | 0.005 | 0.004 | — |
| 14 | 0.027 | 0.37 | 0.64 | 0.0001 | 17.5 | 2.4 | 0.007 | 0.002 | — |
| 15 | 0.021 | 0.28 | 0.21 | 0.0002 | 16.5 | 2.5 | 0.015 | 0.002 | — |
| A | 0.005 | 0.35 | 0.25 | 0.0001 | 20.5 | 1.1* | 0.001 | 0.002 | — |
| B | 0.004 | 0.55 | 0.11 | 0.0005 | 15.4 | 5.5* | 0.002 | — | — |
| C | 0.034 | 0.25 | 0.32 | 0.0074* | 15.2 | 3.5 | 0.007 | 0.005 | — |
| D | 0.021 | 0.49 | 0.33 | 0.0009 | 15.4 | 3.3 | 0.065* | — | 0.020 |
| E | 0.006 | 0.04 | 0.33 | 0.0003 | 15.4 | 3.3 | 0.014 | —* | —* |

| | (Weight %, balance: Ni) | | | | | | | | |
|---|---|---|---|---|---|---|---|---|---|
| Symbol | Hf | Mo | W | Fe | Ta | Ca | W + Mo | Others | Division |
| 1 | — | — | — | — | — | — | — | | Examples of the Invention |
| 2 | — | 10.4 | — | 4.8 | 1.2 | 0.002 | 10.4 | | |
| 3 | 0.775 | — | — | 5.6 | — | — | — | V: 0.1 | |
| 4 | — | — | — | 4.9 | — | — | — | | |
| 5 | — | — | — | 9.2 | — | — | — | Nb: 0.8 | |
| 6 | — | — | 10.5 | 4.5 | 0.5 | — | 10.5 | | |
| 7 | 0.005 | — | 5.6 | 3.6 | — | — | 5.6 | Ti: 0.2, Y: 0.02 | |
| 8 | — | — | — | 0.2 | — | — | — | La: 0.03 | |
| 9 | — | 8.7 | 4.5 | 6.8 | — | 0.002 | 13.2 | La: 0.01, Ce: 0.02 | |
| 10 | — | — | — | 2.1 | 0.2 | — | — | V: 0.8, Nd: 0.02 | |
| 11 | — | 12.2 | — | 3.9 | — | — | 12.2 | V: 0.1, Mg: 0.0035 | |
| 12 | — | 4.9 | — | — | 0.9 | 0.003 | 4.9 | | |
| 13 | — | 7.5 | — | 0.2 | 1.7 | 0.002 | 7.5 | Nb: 0.5, V: 0.2 | |
| 14 | — | — | 5.5 | 1.3 | — | 0.007 | — | Ti: 2.8, Nb: 0.2, Mg: 0.0052 | |
| 15 | — | — | — | 2.1 | — | — | — | Y: 0.03 | |
| A | — | — | — | 3.5 | — | — | — | Ti: 0.1 | Comparative examples |
| B | — | — | — | 3.4 | — | — | — | | |
| C | 0.00 | — | — | 4.0 | — | — | — | Y: 0.02 | |
| D | — | — | — | 4.1 | — | 0.001 | — | | |
| E | —* | — | — | 4.1 | — | 0.006 | — | | |

*shows the outside of the range defined in this invention.

To evaluate carburization resistance, high-temperature strength, hot workability and weldability, each test was conducted in the following manner.

(1) Pack carburization test (evaluation of carburization resistance)

Test specimen: 4 mm in thickness, 20 mm in width and 30 mm in length

Test method: A test specimen as inserted into a caruburizing agent, heated at 1150° C. and kept therein for 48 hours, and then the C content in the center in the direction of plate thickness of the test specimen was analyzed by inductively couple plasma (ICP).

Evaluation: Judged to be excellent in carburization resistance when the amount of carburized C is 0.2% or less.

(2) Creep rupture test (evaluation of high-temperature strength)

Test specimen: 6.0 mm in diameter and 30 mm in mark distance

Test method: To measure an rupture time under the conditions of a temperature of 1150° C. and a loading stress of 0.9 kgf/mm$^2$.

Evaluation: Judged to be excellent in high-temperature strength when the rupture time is 500 hours or more.

(3) Greeble test (evaluation of hot workability)

Test specimen: A round bar test specimen with a diameter of 10 mm in a parallel part and a length of 130 mm Test method: After the specimen was heated at 1200° C. for 5 minutes, cooled at 100° C./min. to 1000° C. and then drawn at a strain rate of 5/s. After rupture, the sample was cooled with He gas, and then the reduction of area was measured.

Evaluation: Judged to be excellent in hot workability when the ratio of reduction of area is 60% or more.

(4) Longitude-varestraint test (evaluation of weldability)

Test specimen: 12 mm in thickness, 50 mm in width and 200 mm in length

Test method: The test specimen was subjected to TIG welding at an electric current of 200 A, a voltage of 17 V, and a welding rate of 15 cm/min. After that, 2% bending strain was applied to the specimen, to determine the total cracking length of the heat-affected zone (HAZ).

Evaluation: Judged to be excellent when the total cracking length is 5 mm or less.

The test results are shown in Table 2.

TABLE 2

| Symbol | C amount (%) | Rupture time (hr) | Reduction of area (%) | Total cracking length (mm) | Division |
|---|---|---|---|---|---|
| 1 | 0.13 | 542.5 | 61.4 | 5 | Examples of the invention |
| 2 | 0.11 | 775.4 | 76.9 | 0 | |
| 3 | 0.10 | 550.6 | 73.5 | 3 | |
| 4 | 0.10 | 520.5 | 67.9 | 3 | |
| 5 | 0.13 | 598.5 | 74.0 | 1 | |
| 6 | 0.06 | 724.5 | 78.8 | 2 | |
| 7 | 0.10 | 650.2 | 72.5 | 2 | |
| 8 | 0.08 | 598.5 | 68.9 | 2 | |
| 9 | 0.19 | 768.9 | 80.5 | 1 | |
| 10 | 0.06 | 612.5 | 66.4 | 5 | |
| 11 | 0.12 | 770.3 | 65.4 | 4 | |
| 12 | 0.07 | 715.9 | 82.5 | 0 | |
| 13 | 0.18 | 812.5 | 67.8 | 3 | |
| 14 | 0.16 | 772.5 | 70.2 | 2 | |
| 15 | 0.18 | 550.0 | 85.6 | 0 | |
| A | 0.55 | 120.5 | 82.5 | 0 | Comparative Examples |
| B | 0.05 | 535.5 | 25.0 | 20 | |
| C | 0.11 | 630.5 | 32.5 | 15 | |
| D | 0.14 | 580.9 | 49.8 | 12 | |
| E | 0.15 | 564.5 | 44.2 | 10 | |

As is evident from Table 2, the alloys 1 to 14 of the present invention containing Al in a range of 2.1 to less than 4.5% are excellent in any items of hot workability, carburization resistance, weldability and creep rupture strength. On the other hand, in the comparative alloy A whose C and Al contents are outside from the ranges defined in the present invention, the amount of carburized C is as significantly high as 0.55%, and the rupture time is as extremely short as 120 hours, and this alloy is not excellent in both carburization resistance and creep rupture strength. In addition, the comparative alloy B whose Al content exceeds the upper limit defined in the present invention shows a greeble reduction of area as low as 25%, and the total cracking length in the HAZ in the longitude-varestraint test is 20 mm, and this alloy can be seen to be inferior in both hot workability and weldability. In addition, both the comparative alloy C with a high S content and the comparative alloy D with a high N content are poor in hot workability and weldability. The comparative alloy E whose Cr content is less than the lower limit defined in the present invention is inferior in carburization resistance. Further, the comparative alloys F whose Si content is high and the comparative alloy G containing none of B, Zr and Hf are not excellent in hot workability and weldability.

The alloy the present invention is an alloy having creep rapture strength satisfactory for use as a high-temperature strength member excellent in hot workability, weldability, carburization resistance and coking resistance. In particular, the alloy of the present invention demonstrates the above-described excellent characteristics under the environment of thermal cracking and heating cycle where carburization, oxidation and temperature change are repeated such as in tubes used particularly in ethylene cracking furnaces. As a result, the alloy of the present invention can be used to enable operation at a higher temperature, to prolong the period of continuous operation, and to extend the span for replacing with a new material due to the improvement of durability.

What is claimed is:

1. A heat resistant Ni base alloy comprising on a mass % basis:

C: 0.1% or less,

Si: 2% or less,

Mn: 2% or less,

S: 0.005% or less,

Cr: 10to25%,

Al: 2.1 to less than 4.5%,

N: 0.055% or less, 0.001 to 1% in total of one or more elements of B: 0.03% or less, Zr: 0.2% or less and Hf: 0.8% or less, 2.5 to 15% in total of one or more elements of Mo: 0.01 to 15% and W: 0.01 to 9%, Ti: 0 to 1%, either one or both of Mg and Ca are contained in an amount of 0.0005 to 0.01% and 0.0005 and 0.01%, respectively, Fe: 0 to 10%, Nb: 0 to 1%, V: 0 to 1%, Ta: 0 to 2%, Y: 0 to 0.1%, La: 0 to 0.1%, Ce: 0 to 0.1%, Nd: 0 to 0.1%, Cu: 0 to 5%, Co: 0 to 10%, and the balance being substantially Ni.

2. The heat resistant Ni base alloy according to claim 1, wherein the Fe content is 0.1% to 10%.

3. The heat resistant Ni base alloy according to claim 1, in which $\{(1.178\ Mg+Ca)/S\} \geqq 0.5$.

4. The heat resistant Ni base alloy according to claim 1, in which $\{(1.178\ Mg+Ca)/S\}=0.5.\sim 3.0$.

5. The heat resistant Ni base alloy according to claim 1, in which {(1.178 Mg+Ca)/S}≧0.5 and the Fe content is 0.1% to 10%.

6. The heat resistant Ni base alloy according to claim 1, in which {(1.178 Mg+Ca)/S}=0.5.~3.0, and the Fe content is 0.1% to 10%.

7. A heat resistant Ni base alloy comprising on a mass % basis,

C: 0.007% or less,

Si: 0.01 to 1%,

Mn: 1% or less,

S: 0.0025% or less,

Cr: 12 to 19%,

Al: 2.1 to less than 3.8%,

N: 0.045% or less, 0.001 to 1% in total of one or more elements of B: 0.03% or less, Zr: 0.2% or less and Hf: 0.8% or less, Mo: 2.5 to 12%, either one or both of Mg and Ca are contained in an amount of 0.0005 to 0.01% and 0.0005 and 0.01%, respectively, Fe: 0.1 to 10%, and the balance being essentially Ni.

8. The heat resistant Ni base alloy according to claim 7, in which {(1.178 Mg+Ca)/S}≧0.5.

9. The heat resistant Ni base alloy according to claim 7, in which {(1.178 Mg+Ca)/S}=0.5.~3.0.

10. A heat resistant Ni base alloy tube comprising on a mass % basis:

C: 0.1 % or less,

Si: 2% or less,

Mn: 2% or less,

S: 0.005% or less,

Cr: 10 to 25%,

Al: 2.1 to less than 4.5%,

N: 0.055% or less, 0.001 to 1 % in total of one or more elements of B: 0.03% or less, Zr: 0.2% or less and Hf: 0.8% or less, 2.5 to 15% in total of one or more elements of Mo: 0.01 to 15% and W: 0.01 to 9%, Ti: 0 to 1%, either one or both of Mg and Ca are contained in an amount of 0.0005 to 0.01% and 0.0005 and 0.01%, respectively, Fe: 0 to 10%, Nb: 0 to 1%, V: 0 to 1%, Ta: 0 to 2%, Y: 0 to 0.1%, La: 0 to 0.1%, Ce: 0 to 0.1%, Nd: 0 to 0.1%, Cu: 0 to5%, Co: 0 to 10%, and the balance being substantially Ni.

11. The heat resistant Ni base alloy according to claim 10, in which {(1.178 Mg+Ca)/S}≧0.5.

12. The heat resistant Ni base alloy according to claim 10, in which {(1.178 Mg+Ca)/S}=0.5.~3.0.

13. A heat resistant Ni base alloy tube used in reforming furnaces or ethylene cracking furnaces comprising on a mass % basis:

C: 0.1% or less,

Si: 2% or less,

Mn: 2% or less,

S: 0.005% or less,

Cr: 10 to 25%,

Al: 2.1 to less than 4.5%,

N: 0.055% or less, 0.001 to 1% in total of one or more elements of B: 0.03% or less, Zr: 0.2% or less and Hf: 0.8% or less, 2.5 to 15% in total of one or more elements of Mo: 0.01 to 15% and W: 0.01 to 9%, Ti: 0 to 1%, either one or both of Mg and Ca are contained in an amount of 0.0005 to 0.01% and 0.0005 and 0.01%, respectively, Fe: 0 to 10%, Nb: 0 to 1%, V: 0 to 1%, Ta: 0 to 2%, Y: 0 to 0.1%, La: 0 to 0.1%, Ce: 0 to 0.1%, Nd: 0 to 0.1%, Cu: 0 to 5%, Co: 0 to 10%, and the balance being substantially Ni.

14. The heat resistant Ni base alloy according to claim 13, in which {(1.178 Mg+Ca)/S}≧0.5.

15. The heat resistant Ni base alloy according to claim 13, in which {(1 78 Mg+Ca)/S}=0.5.~3.0.

16. In a method of producing petrochemical products using reforming furnaces or ethylene cracking furnaces having tubes exposed to a carburization atmosphere, the improvement comprising the tubes being made from a heat resistant Ni base alloy comprising on a mass % basis:

C: 0.1% or less,

Si: 2% or less,

Mn: 2% or less,

S: 0.005% or less,

Cr: 10 to 25%,

Al: 2.1 to less than 4.5%,

N: 0.055% or less, 0.001 to 1% in total of one or more elements of B: 0.03% or less, Zr: 0.2% or less and Hf: 0.8% or less, 2.5 to 15% in total of one or more elements of Mo: 0.01 to 15% and W: 0.01 to 9%, Ti: 0 to 1%, either one or both of Mg and Ca are contained in an amount of 0.0005 to 0.01% and 0.0005 and 0.01%, respectively, Fe: 0 to 10%, Nb: 0 to 1%, V: 0 to 1%, Ta: 0 to 2%, Y: 0 to 0.1 %, La: 0 to 0.1%, Ce: 0 to 0.1%, Nd: 0 to 0.1%, Cu: 0 to5%, Co: 0 to 10%, and the balance being substantially Ni.

17. The method according to claim 16, wherein the Ti content is 0.005 to 1% by mass.

18. The method according to claim 16, wherein the Ti content is 0.005 to 1%, and the Fe content is 0.1 to 10%.

19. The heat resistant Ni base alloy according to claim 16, in which {(1.178 Mg+Ca)/S}≧0.5.

20. The heat resistant Ni base alloy according to claim 16, in which {(1.178 Mg+Ca)/S}=0.5.~3.0.

21. The method according to claim 16, wherein the Ti content is 0.005 to 1% by mass and {(1.178 Mg+Ca)/S}≧0.5.

22. The method according to claim 16, wherein the Ti content is 0.005 to 1% by mass and {(1.178 Mg+Ca)/S}= 0.5.~3.0.

23. The method according to claim 16, wherein the Ti content is 0.005 to 1% by mass and {(1.178 Mg+Ca)/S}≧0.5, and the Fe content is 0.1% to 10%.

24. The method according to claim 16, wherein the Ti content is 0.005 to 1% by mass and {(1.178 Mg+Ca)/S}= 0.5.~3.0, and the Fe content is 0.1% to 10%.

* * * * *